US005303654A

United States Patent [19]

Held

[11] Patent Number: 5,303,654

[45] Date of Patent: Apr. 19, 1994

[54] COMBINATION PROJECTILE FOR COMBATTING ARMORED TARGETS

[75] Inventor: Manfred Held, Aresing, Fed. Rep. of Germany

[73] Assignee: Deutsche Aerospace AG, München, Fed. Rep. of Germany

[21] Appl. No.: 858,286

[22] Filed: Nov. 4, 1977

Related U.S. Application Data

[63] Continuation of Ser. No. 631,632, Nov. 10, 1975, abandoned.

[30] Foreign Application Priority Data

Nov. 8, 1974 [DE] Fed. Rep. of Germany ..... 24529428

[51] Int. Cl.[5] ..... F42B 12/18

[52] U.S. Cl. ..... 102/476

[58] Field of Search ..... 102/24 HC, 56 SC, 306, 102/307, 308, 309, 310, 476

[56] References Cited

U.S. PATENT DOCUMENTS 4,004,515 1/1977 Mallory et al. ..... 102/56 SC
4,063,512 12/1977 Davis ..... 102/56 SC

FOREIGN PATENT DOCUMENTS 1002092 3/1952 France ..... 102/56 SC
1051407 12/1966 United Kingdom ..... 102/56 SC

*Primary Examiner*—Stephen C. Bentley
*Attorney, Agent, or Firm*—Anderson Kill Olick & Oshinsky

[57] ABSTRACT

A combined projectile is formed of a leading projectile part and a trailing projectile part disposed in coaxial relation and spaced apart by a defined constructional distance. The trailing projectile part can be a weight projectile. Further, the trailing projectile may include a device for retarding detonation relative to the detonation of the leading projectile part. The leading projectile part forms an opening in a target and permits the trailing projectile part to move unimpeded through the opening.

2 Claims, 2 Drawing Sheets

COMBINATION PROJECTILE FOR COMBATTING ARMORED TARGETS

This is a continuation of application Ser. No. 631,632 filed Nov. 10, 1975, now abandoned.

SUMMARY OF THE INVENTION

The invention relates to a combined projectile with a number of individual projectiles succeeding one another coaxially, for attacking armoured targets, with protective devices consisting of a number of walls and/or layers, or wall and layer combinations, which are situated in succession to one another and between which free gaps are provided, a "spelling" effect being obtained by one or more special layers, including so-called reaction layers, particularly by an explosive layer and a corresponding inert disruptor layer.

Hollow charge projectiles, by the detonation of their charge and by the aid of the lining provided in the recess in the explosive charge, generate a so-called hollow charge spike of extremely high energy. This spike is capable of penetrating a thickness of very strong steel plates which corresponds to between 4 and 10 times the calibre of the projectile. This extreme penetrative power of the spike is due to its elongated form at a short distance and to its succession of particles at a greater distance between charge and target, on which latter it acts for a longer time, as well as to its extremely high peak velocities of up to 12000 m/sec. This leads to such high and long-lasting pressure beads in the target material that regardless of its strength properties it undergoes displacement in accordance with the axis of the spike, a slender funnel-shaped boring being formed.

Many measures have already been developed and adopted against the hollow charges representing a highly effective weapon. The most obvious method, i.e. the reinforcement of the armouring, is subject to strict limits owing to the fact that the thereby considerably increased over-all weight becomes unacceptable. With marine vessels likewise, however, with which weight does not play such a great part as in the case of land vessels and particularly aircraft, the armouring cannot be increased in thickness in proportion to the increased penetrating power of heavy-calibre hollow charges.

The policy of continually increasing the thickness of the armouring is being abandoned to an ever-greater extent in favour of new measures aimed at reducing its weight and thickness and at the same time at improving its resistance to penetration. Known protective devices consist of multi-layer walls, the separate layers being made of different materials. The purpose of these special wall constructions is to stop the hollow charge spike in the protective material by dispersing its penetrative action.

Special protective devices of this complex construction are nowadays attacked by means of slender weight projectiles of very thick material and considerable hardness, which by reason of their very high flight velocities simply penetrate these protective structures with their kinetic energy.

As a protection against weight projectiles of this kind, one of the methods adopted in present-day armourings is to install, in the case of multi-layer protective devices, some of which have a number of walls and layers or layer combinations at a free distance from one another, disruptor walls with reaction layers such as explosive layers, in order to generate the "spelling" effect, these layers being detonated directly or indirectly by the projectile on its impact and then flinging adjacent inert disruptor layers into the trajectory of the projectile entering or penetrating, in their subsequent reaction or detonation. In this case the destruction of a hollow charge spike occurs owing to the fact that the latter is chopped up over considerable portions of its length and the individual particles of the spike are deflected additionally. The spike, of which the penetrative force is a homogeneous steel wall is otherwise so great, thus loses its perforating effect and remains in a divergent crater in an armour plate following disruptor walls of this kind. In defense against the aforementioned weight projectiles likewise, disruptor walls of this kind, particularly with explosive layers, are highly effective, the reason being that the weight projectiles are deflected in their trajectory by the inert wall parts flung away with considerable kinetic energy by the layer of explosive in process of detonating. The weight projectiles thus tilt out of the trajectory by their centre of gravity and to some extent make impact transversely on a subsequent armour plate, so that a considerable proportion of their inherent kinetic energy is consumed in the direction of penetration.

The purpose of the invention is to provide ammunition capable of penetrating even the multi-structure protective devices with disruptor walls described in the foregoing.

For the solution of this problem the invention proposes a combined projectile of the type mentioned at the beginning, characterized by at least one follow-up projectile as a penetration projectile and at least one preliminary projectile preceding the latter and functioning as a hollow charge for the initiation of the spelling of the disruptor layer and for detonating the explosive layer of the protective device, and a defined constructional distance and also possibly a defined retardation in the detonation between the preliminary projectile and the follow-up projectile, in order to enable the latter to penetrate unimpeded through the entire protective device.

In one version of the invention, the follow-up projectile or penetrating projectile used consists of a weight projectile.

As a further development of the invention, the follow-up projectile or penetrating projectile consists of a hollow charge of greater calibre than the preliminary projectile, so that in this case the follow-up projectile, from the point of view of its military effectiveness, functions as the main charge.

The following considerations, confirmed by tests, ensure that the aforementioned special protective devices cap likewise be successfully combated with the combined charge to which the invention relates. The preliminary charge, in virtue of its efficiency, is capable of initiating the splitting of the disruptor layer or of causing the explosive layer to detonate in advance. The defined constructional distance in conjunction with a defined retardation between the detonations of the respective two charges, in the case of a hollow charge used as the follow-up projectile or main projectile, ensures the full military efficiency of the follow-up charge on or in the target, and a further main purpose to be achieved, in the case of the protective devices of complex structure to be combated, is to penetrate a final fixed wall, usually the actual wall of the housing of a tank or other protective structure. This can be achieved both by the weight projectile in question, if it is used unimpeded, and the hollow charge spike of the follow-up projectile or main projectile, which is beyond doubt effective, in the unimpeded state, against protective walls hitherto known.

BRIEF DESCRIPTION OF THE INVENTION

The special effect of the combination projectile proposed is shown in detail by the following description by reference to the drawing. The set of diagrams 1a, 1b and 1c show the cycle of action of a combined projectile with a weight projectile as its follow-up projectile, while the set of diagrams 2a, 2b and 2c show that of a combined projectile with a hollow charge as its follow-up projectile or main projectile.

DETAILED DESCRIPTION OF THE INVENTION

Figure 1A:
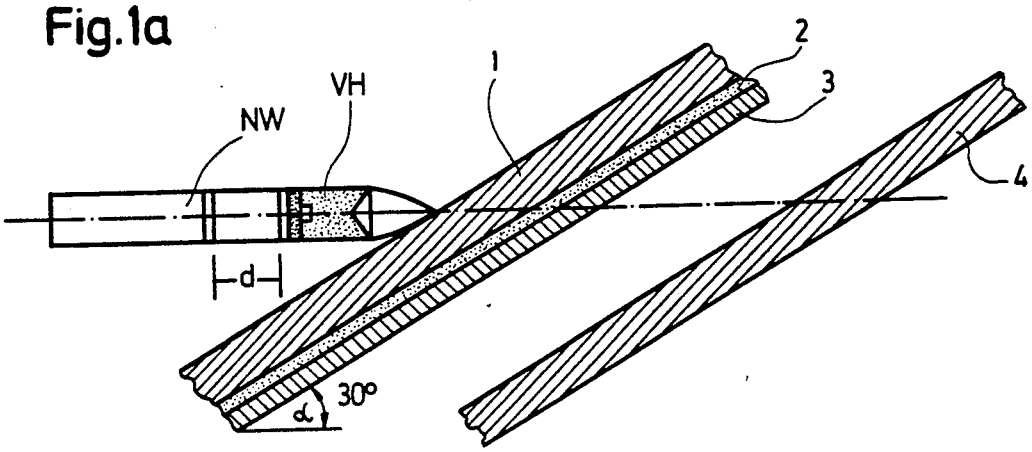
Figure 1B:
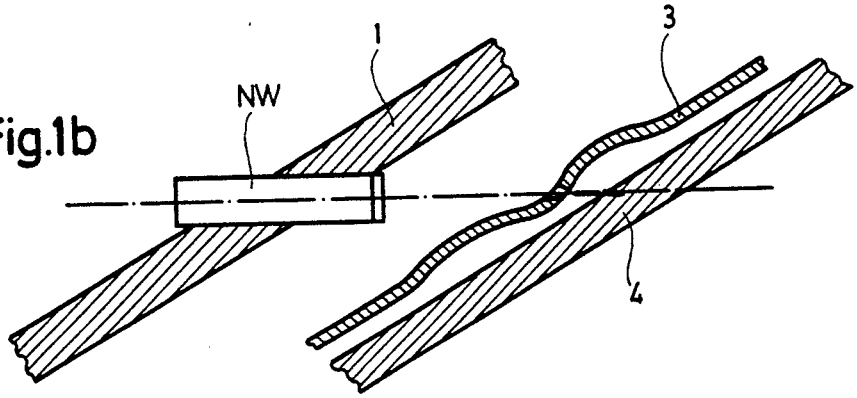
Figure 1C:
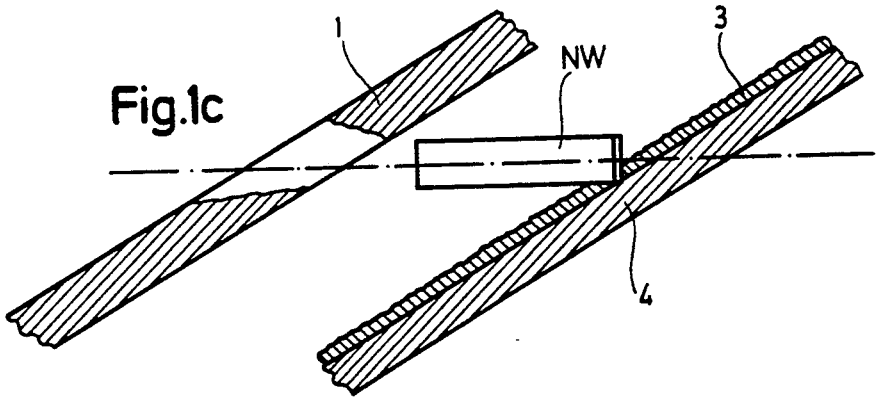

According to FIGS. 1a–1c the protective device consists of two protective walls succeeding each other a certain distance apart, a front set of walls with a relatively thick inert front protective wall 1, e.g. of armour steel, an intermediate layer 2, of explosive, and a relatively thin inert disruptor layer 3. The rear (inner) relatively thick protective wall 4 again consists of amour steels.

The defensive effect of a complex protective device of this kind, the distance between the first set of walls 1,2,3, and the second wall 4 being likewise selected from this point of view, that the disruptor layer 3 is flung in the direction of the rear protective wall 4 by the detonating explosive layer 2, which is detonated by the projectile penetrating the front wall of the target. In this process the explosive's power and mass and the distance between the front protective wall 1 and the rear protective wall 4 are selected to ensure that on the passage of the projectile or of a hollow charge spike it or they will be deflected or impeded by the accelerated disruptor layer 3, as already described farther back.

In the case of the invention the hollow charge spike of the preliminary projectile VH, after it has detonated the explosive layer 2, will be impeded by the disruptor layer 3, thus being deprived of any further penetrative effect. On the other hand, however, it is precisely the preliminary projectile VH that with this action on the target makes way for the follow-up projectile NW or weight projectile, which can then fully penetrate the rear protective wall 4 unimpeded. A decisive feature of the combination of projectiles is that between the preliminary projectile VH and the follow-up projectile NW or weight projectile a defined constructional distance d is provided, so that the follow-up projectile NW does not make impact by its end face on the rear protective wall 4 until the disruptor layer 3 has already reached the said rear protective wall 4 (FIG. 1c).

The process will be elucidated by a calculation of an example. This is accomplished by the following time sequences:

| | |
|---|---|
| From the impact of the point of the combination projectile on the front wall 1 to the ignition of the percussion cap of the preliminary projectile VH the time elapsing is: | 10 μsec. |
| The complete reaction of the detonator in the fuse system of the detonation device of the preliminary projectile occupies | 3 μsec. |
| The complete detonation of this hollow charge, in the event of a detonation velocity of 7 km/sec and a distance of 49 mm to be covered, requires | 7 μsec. |
| The time occupied by the travel of the hollow charge spike, with a contact distance of 70 mm for this hollow charge and with a spike velocity of 7 km sec, amounts to | 10 μsec. |
| With a crater base speed of 3 km/sec the penetration time, at an angle of passage of 60° to the normal line to the plate, and in the case of a front protective wall of 40 mm in thickness, amounts to | 27 μsec. |
| The detonation time for the explosive layer 2 is | 10 μsec. |
| The complete detonation of the explosive layer 2 occupies | 58 μsec. |
| The sum of all these periods thus amounts to: | 125 μsec. |

With the detonative conversion of the explosive layer 2 the disruptor layer 3 is considerably accelerated. Tests show that under the prevailing conditions a high degree of disruption can be obtained if the disruptor layer 3, with an angle of passage of 60°, flies away, perpendicularly to the wall of the target, at speeds of about 500 m/s. With an assumed perpendicular distance through the air of 200 mm between the front wall 1 and the rear wall 4, therefore, the flight velocity of the disruptor layer 3 is found to be 400 μsec.

It follows that a total time of 525 μsec elapses from the impact of the tip of projectile on the front wall 1 to the impact of the disruptor layer 3 on the rear wall 4.

While these processes are in progress, the weight projectile NW covers the following distance:

| | |
|---|---|
| The contact distance (length of cap of hollow charge): | 70 m. |
| The length of the hollow charge itself: | 100 mm. |
| The distance through the front protective wall | 80 mm |
| The distance between the front protective wall 1 and the rear protective wall 4, measured in the direction of firing: | 400 mm. |
| Total: | 650 mm. |

If this distance of 650 mm is divided by the time previously calculated of 525 μsec between the impact of the combination projectile on the front wall 1 and the impact of the disruptor layer 3 on the rear wall 4, this calculation shows that a speed of about 1240 m/sec for the weight projectile is still permissible.

This means that insofar as the velocity of the weight projectile NW is less than 1240 m/sec it can no longer be relied upon to overtake the departing disruptor layer 3 before the latter makes impact on the rear wall 4. If, however, the speed of the weight projectile NW exceeds 1240 m/sec, then the departing disruptor layer 3 and the weight projectile NW encounter each other, leading to deflections of the latter, whereby it is deprived of its penetrative power.

It follows that the defined constructive distance displays a major part and constitutes a decisive parameter for the control of the complicated processes in the penetration of such complex wall structures.

FIG. 1b shows an intermediate situation with a time sequence of about 250 μ, while in FIG. 1c the weight projectile NW, after a flight time of 525 μsec, makes straight impact on the rear protective wall 4, after which it completely penetrates the latter.

For the example considered, approximately each extra 100 m/sec in the flight velocity for the weight projectile NW requires approximately an extra 40 mm in the constructional distance d between the weight projectile NW and the preliminary projectile VH.

Figure 2A:
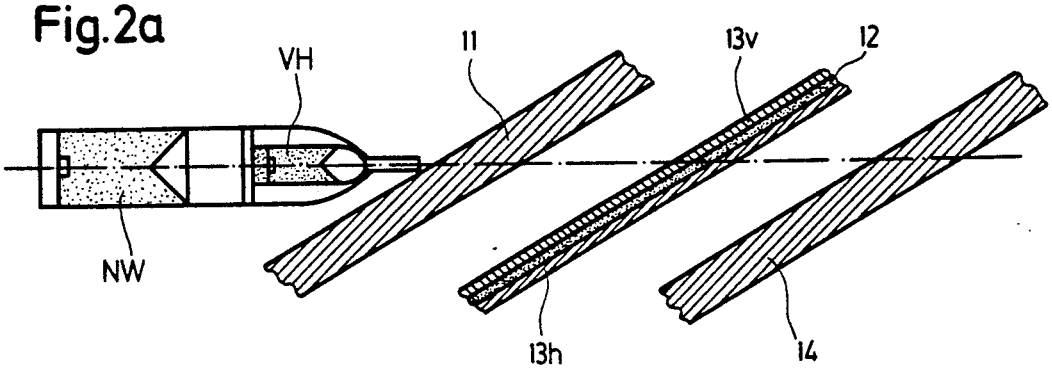
Figure 2B:
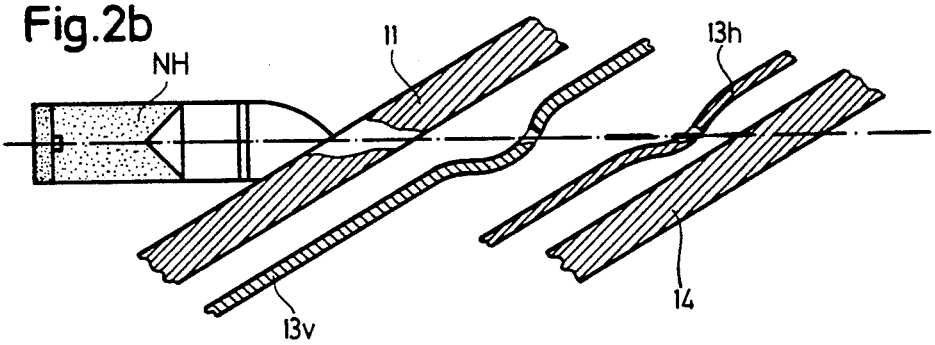
Figure 2C:
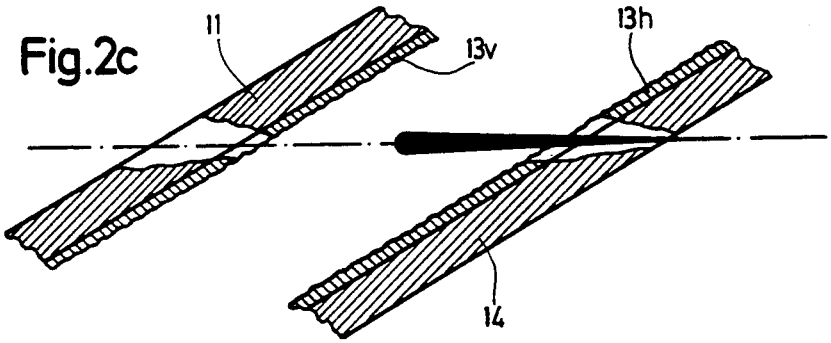

FIGS. 2a–2c show a complex protective device with three walls, with a front wall 11, a central wall combination with a central explosive layer 12, a front disruptor wall 13v and a rear disruptor layer 13h and, finally, a rear wall 14. In this case the combination projectile consists of two interconnected hollow charge projectiles, again a front hollow charge projectile VH as the preliminary projectile and a rear hollow charge NH projectiles NH as the follow-up projectile.

In the attack on the target the following periods elapse up to the moment when the explosive layer 12 is detonated by the preliminary projectile VH:

| | |
|---|---|
| From impact of point of combination projectile up to the response of the percussion cap of the preliminary projectile VH the period elapsing amounts to: | 10 μsec. |
| Complete detonation time of detonator of preliminary projectile VH: | 3 μsec. |
| Complete detonation time of hollow explosive charge: | |
| $\frac{45 \text{ mm length of charge}}{7 \text{ mm}/\mu\text{sec}} =$ | 7 μsec. |
| Cycle of spike up to impact of spike on front of wall 11: | |
| $\frac{70 \text{ mm length of cap of projectile}}{7 \text{ mm}/\mu\text{sec}} =$ | 10 μsec. |
| Crater perforation time: | |
| $\frac{81 \text{ mm}}{3 \text{ mm/sec}} =$ | 27 μsec. |
| Period for passage of spike between rear of wall 11 and explosive layer 12: | |
| $\frac{300 \text{ mm}}{4 \text{ mm/sec}} =$ | 75 μsec. |
| Detonation time of explosive layer 12 = | 10 μsec. |
| Time for complete detonation of explosive layer 12: | 43 μsec. |
| The sum of all these periods amounts to: | 185 μsec. |

At the same time, the flight time for the front disruptor layer 13v as far as the front wall 11, with a velocity of 500 m/sec and a perpendicular free distance of 150 mm, amounts to 300 μsec. It follows that the total time from the impact of the point of the combination projectile on the front wall 11 to the impact of the disruptor layer 13v on the rear of the front wall 11 is 185 μsec+300 sec=485 μsec.

For the hollow charge of the follow-up projectile or of a main projectile, insofar as the dimensions of the latter are greater than those of the preliminary projectile VH, we have the following time cycles:

| | |
|---|---|
| From detonation order to response of electrical detonator the time elapsing amounts to: | 10 μsec. |
| The complete detonation of the flame detonator occupies: | 3 μsec. |
| The complete detonation of the explosive charge, depending on the length, occupies: | 20 μsec. |
| The period for the movement of the spike as far as the front wall 11, calculated as from the tip of the lining, amounts to: | 35 μsec. |
| $\frac{350 \text{ mm}}{10 \text{ mm}/\mu\text{sec}}$ | |
| The crater perforation time | |
| $\frac{80 \text{ mm}}{8 \text{ mm}/\mu\text{sec}}$ amounts to: | 10 μsec. |

-continued

| | |
|---|---|
| This results in a total time of: | 78 μsec. |

If the hollow charge of the follow-up projectile NH or of the main projectile were detonated simultaneously with the hollow charge of the preliminary projectile VH, then the hollow charge spike of the follow-up projectile NH would inevitably be chopped up by the disruptor wall 13v still present in the preliminary flight phase, whereby it would be deprived of its penetrative effect on the rear wall 14v. The retardation of the detonation of the hollow charge of the follow-up projectile NH, in the present example by 485−78=407 μsec, therefore constitutes, according to the invention, a factor enabling the hollow charge of the follow-up projectile NH to take full effect unimpeded on the target.

FIG. 2b again shows an intermediate situation in which the disruptor layers 13v and 13h, already accelerated, are on the way to the front wall 11 and rear wall 14 respectively. The impeded or chopped hollow charge spike of the preliminary projectile VH is just about to become "spent" in the rear wall 14. In FIG. 2c the hollow charge spike of the follow-up projectile NH or main projectile is just penetrating the rear wall 14, with the disruptor wall 13h, which has already long made impact.

I claim:

1. A combined projectile having a leading end and a trailing end and including at least two projectile parts in coaxial relation with one another with one of said projectile parts forming the leading end of said projectile and the other said projectile part located behind the one of said projectile parts, wherein the improvement comprises that the one of said projectile parts comprises a hollow charge part, means for effecting a predetermined retardation between the detonation of the one of said projectile parts and the movement of the other said projectile part along the path of the one of said projectile parts including at least first means for providing a defined constructional distance in the axial direction of the projectile between said two projectile parts and spacing apart the trailing end of the one of said projectile parts and the leading end of the other of said projectile parts for effecting a time delay between the detonation of the one of said projectile parts and the subsequent movement of the other said projectile part along the path of the one of said projectile parts so that in the use of the projectile against a selected multi-walled target the hollow charge part of the one of said projectile parts acts as a penetration member for penetrating at least a portion of the walls of the selected target for forming an opening therethrough whereupon after the hollow charge has completed its penetrating action the other said projectile part can penetrate unimpeded through the opening formed by said hollow charge into the target for providing the military effectiveness of the combined projectile against the target with said means being determined in accordance with the spaced arrangement of the walls in the target.

2. A combined projectile, as set forth in claim 1, wherein the other said projectile path includes a hollow charge, and said means for effecting a predetermined retardation includes retardation means for delaying the detonation of the hollow charge of the other said projectile part relative to the detonation of the one of said projectile parts so that the combination of said first means and said retardation means provides the desired delay in the detonation of the other said projectile parts so that the one of said projectile parts does not impede the passage of the hollow charge of the other said projectile part into the target.

* * * * *